US005507399A

United States Patent [19]

Hermanson

[11] Patent Number: 5,507,399

[45] Date of Patent: Apr. 16, 1996

[54] ERECTABLE WIRE FRAME FOR WIRE SCULPTURES AND THE LIKE

[75] Inventor: Terry Hermanson, New York, N.Y.

[73] Assignee: Mr. Christmas, Inc., New York, N.Y.

[21] Appl. No.: 236,336

[22] Filed: May 2, 1994

[51] Int. Cl.[6] ..... A47F 5/14

[52] U.S. Cl. ..... 211/181; 211/198; 248/175

[58] Field of Search ..... 211/181, 198; 248/175, 166

[56] References Cited

U.S. PATENT DOCUMENTS

| | | | |
|---|---|---|---|
| 160,980 | 3/1875 | Whipple . | |
| 1,332,146 | 2/1920 | Riordan et al. | 211/181 X |
| 1,545,072 | 7/1925 | Stearns . | |
| 1,655,004 | 1/1928 | Yurachek . | |
| 1,689,988 | 10/1928 | White | 211/181 X |
| 1,711,585 | 5/1929 | Brunhoff . | |
| 1,747,369 | 2/1930 | Humphrey . | |
| 1,799,540 | 4/1931 | Turner | 248/175 X |
| 2,269,425 | 1/1942 | Bitney . | |
| 2,718,080 | 9/1955 | Eaton . | |
| 4,667,833 | 5/1987 | Jamison . | |
| 4,807,766 | 2/1989 | Compagnucci . | |

*Primary Examiner*—Leslie A. Braun
*Assistant Examiner*—Gwendolyn Wrenn
*Attorney, Agent, or Firm*—Fitzpatrick, Cella, Harper & Scinto

[57] ABSTRACT

An erectable wire frame structure for displaying a wire sculpture. The structure includes upper and lower frame assemblies which are pivotally connected by elbow-like hinges which allow the upper frame assembly to be rotated from a folded, closed position to an open, upright position. Retaining pins lock the frame assemblies in the upright position. Attached to the lower frame assembly is a rear frame assembly which is adapted to extend rearwardly at a predetermined angle from the upper portion thereof. The rear frame assembly cooperates with downwardly extending leg sections of the lower frame assembly to provide a support structure which is free-standing. Wire sculptures, such as light sculptures, can be attached to the wire frame, creating a light display which can be anchored in a lawn, hung on a wall or allowed to stand alone using the rear frame assembly for support. Alternatively, the wire sculpture itself may form a portion of the wire frame structure. When not in use, the wire frame structure can be folded back into a closed position for easy handling and storage.

13 Claims, 3 Drawing Sheets

ERECTABLE WIRE FRAME FOR WIRE SCULPTURES AND THE LIKE

BACKGROUND OF THE INVENTION

1. Field of the Invention

This invention relates generally to erectable wire frames, and more particularly to wire frames for supporting wire sculptures such as outdoor Christmas light sculptures.

2. Description of the Prior Art

Many homeowners like to decorate the inside of their homes on holidays and other occasions as an expression of celebration. Some even decorate the outside of their homes so that passersby can enjoy this means of expression and perhaps, in their own way, share in the celebration. Christmas time is probably the biggest holiday season during which one is apt to see visual displays, for example, in peoples' homes, on peoples' lawns and in shopping malls. Christmas trees decorated with lights and ornaments are standard fare, but more exotic structures, such as lawn displays, add a visual flare that can be seen and appreciated from a greater distance.

Erectable wire frame support structures, which typically include first and second wire/hiding frame components joined by a hinge, are well known. The frame components of such structures are held in an upright position by a retaining means that locks the frame components in place. For example, in U.S. Pat. No. 1,655,004 to Yurachek, there is disclosed a magazine holder with two folding frame components operatively hinged for folding flat against each other when not in use, and for opening into a substantially upright position to form an upright magazine rack. The lower component contains a support held in angular relation by a retaining means, in this case a chain. The upper component is held in operative position by a thumb screw which exerts pressure on the hinge in a direction parallel with the axis of the hinge, so that the frame may be secured in any desired position in relation to the leg structure.

U.S. Pat. No. 2,269,425 to Bitney discloses a wire folding frame for use as a clothes rack. The clothes rack has a lower portion which has a support held in place by a retaining arm, and an upper portion which locks in a generally upright position. The structure disclosed by Bitney is held in an open, clothes supporting position when the inverted triangular upper portion is locked in place. For this purpose, a bridge portion is provided for locking the upper portion in place against the retaining arms.

With particular reference to decorative display structures, the options of the homeowner seeking to create an outdoor display have been somewhat limited. Specifically, commercially available display structures are usually configured for mounting to a vertical planar support surface, such as the exterior of a house, by means of hooks and wires or other fasteners. Alternatively, free-standing lawn display structures are usually provided with one or more fixed vertical members which are insertable into the ground. Neither of the aforementioned configurations provides a display supporting structure which is capable of displaying an illuminated wire frame sculpture in a free standing manner, in a vertical surface mounted manner, or in an anchored-into-the-ground manner.

It is therefore an object of the present invention to provide an erectable display structure which is very, easily manipulated between a compact folded position and an unfolded, display supporting position and which is adapted to display an illuminated wire frame sculpture or the like in each of the display situations discussed above.

It is also an object of the invention to provide an erectable display structure which is an all wire frame having the stability, strength and compactness for the purposes intended.

A further object of the present invention is to provide an erectable display structure which can accommodate light sculptures of various sizes and shapes.

It is another object of the present invention to provide an erectable display structure having upper and lower frame components connected by a hinge and lockable relative to one another by retaining pins which exert a locking force in a direction perpendicular to the axis of the hinge.

It is yet another object of the present invention to provide a structure which is simple in design, portable and economic to manufacture.

SUMMARY OF THE INVENTION

The aforementioned objects, as well as others which will become apparent to those skilled in the art from the disclosure set forth herein, are achieved by an erectable wire frame display structure configured and constructed to remain upright to display an attached illuminated wire frame sculpture when manipulated into an operative position. The wire frame of the present invention can be anchored into a lawn or hung on a wall. Moreover, in accordance with another aspect of the invention, a support element is provided to facilitate a free-standing arrangement of the frame on a substantially planar surface such as, for example, the ground, a driveway, sidewalk or the like.

The wire frame display structure of the present invention includes upper and lower frame assemblies which are connected by a hinge assembly so that one frame assembly can be positioned relative to the other to define both a folded and an unfolded position. In the folded position, for example, the lower and upper frame assemblies are disposed parallel to one another in a side by side relation. As will be readily ascertained by those skilled in the art, manipulation of the frame structure into the folded position facilitates storage and transportation thereof. The unfolded position is achieved by rotating one of the frame assemblies approximately 180° relative to the other, thus exposing a large, upright surface area suitable for supporting an attached illuminated wire frame sculpture.

As indicated, the upper frame assembly is adapted to be rotated from the folded, closed position through a range of about 180° until it is oriented above the lower frame assembly in the open, upright position. In order to provide a stable, upright support surface, locking means are provided to maintain the upper and lower frame assemblies in the unfolded or open position. In accordance with an illustrative embodiment of the present invention, the locking means comprises retaining means integrally formed on the upper frame assembly and at least one retaining pin engageable with the retaining means to prevent relative movement between the upper and lower frame assemblies.

Engageable with an upper section of the lower frame assembly is a rear support assembly which is adapted to extend downwardly and rearwardly therefrom, the lower frame assembly and rear support assembly cooperating to provide a free-standing display supporting structure. The support assembly may comprise a pair of parallel rod members which are interconnected by at least one transverse rod member.

Means for interconnecting the support element and the lower frame assembly are provided to obtain a stable arrangement. In accordance with a preferred embodiment of the present invention, the interconnecting means comprises a plurality of parallel apertures defined in the upper section of the lower frame assembly and a pair of downwardly depending members which each extend below a lower edge surface of the lower frame member and which each define a corresponding aperture. The interlocking means further includes a respective pair of apertures, defined in the parallel rod members of the support element and respectively aligned with the apertures of the lower frame member, and first and second latch means insertable into the respective aligned apertures. Finally, the interlocking means further includes a bent portion at the upper end of each parallel rod member, said bent portions being insertable into the apertures in the upper section of the lower frame member.

Wire sculptures, such as light sculptures of various sizes and shapes, may be attached to the wire frame utilizing any suitable fastening means. In accordance with a modified embodiment of the present invention, a wire sculpture is integrally formed as pan of the frame structure. In either case, the present invention makes it possible to provide a light display that may be anchored in a lawn, erected in a free-standing manner on a substantially flat surface, or secured to a vertically oriented support surface, e.g. a wall. To this end, a plurality of lights may be secured to the wire frame sections defining the sculpture so as to provide a visually attractive, multicolored display which can be seen at night—as well as during the day As indicated above, the upper frame assembly can be rotated into a closed position wherein it is in a face-to-face relationship with the lower frame assembly. In a similar fashion, the rear support assembly can be folded flush against the lower frame assembly. This compact configuration occupies minimum space for easy handling and storage.

These and other objects and features of the present invention will become apparent from the following detailed description considered in conjunction with the accompanying drawings. It is to be understood, however, that the drawings are intended solely for the purpose of illustration and not as a definition of the limits of the invention, for which reference should be made to the appended claims.

DETAILED DESCRIPTION OF THE DRAWINGS

In the drawings, wherein like reference characters denote similar elements throughout the several views:

FIG. 1 is a perspective view of an erectable wire frame constructed in accordance with the teachings of the present invention, shown in an operative position for displaying a wire sculpture, particularly a light sculpture:

FIG. 1*a* is a partially exploded view of FIG. 1;

DETAILED DESCRIPTION OF THE PRESENTLY PREFERRED EMBODIMENTS

Figure 1A:
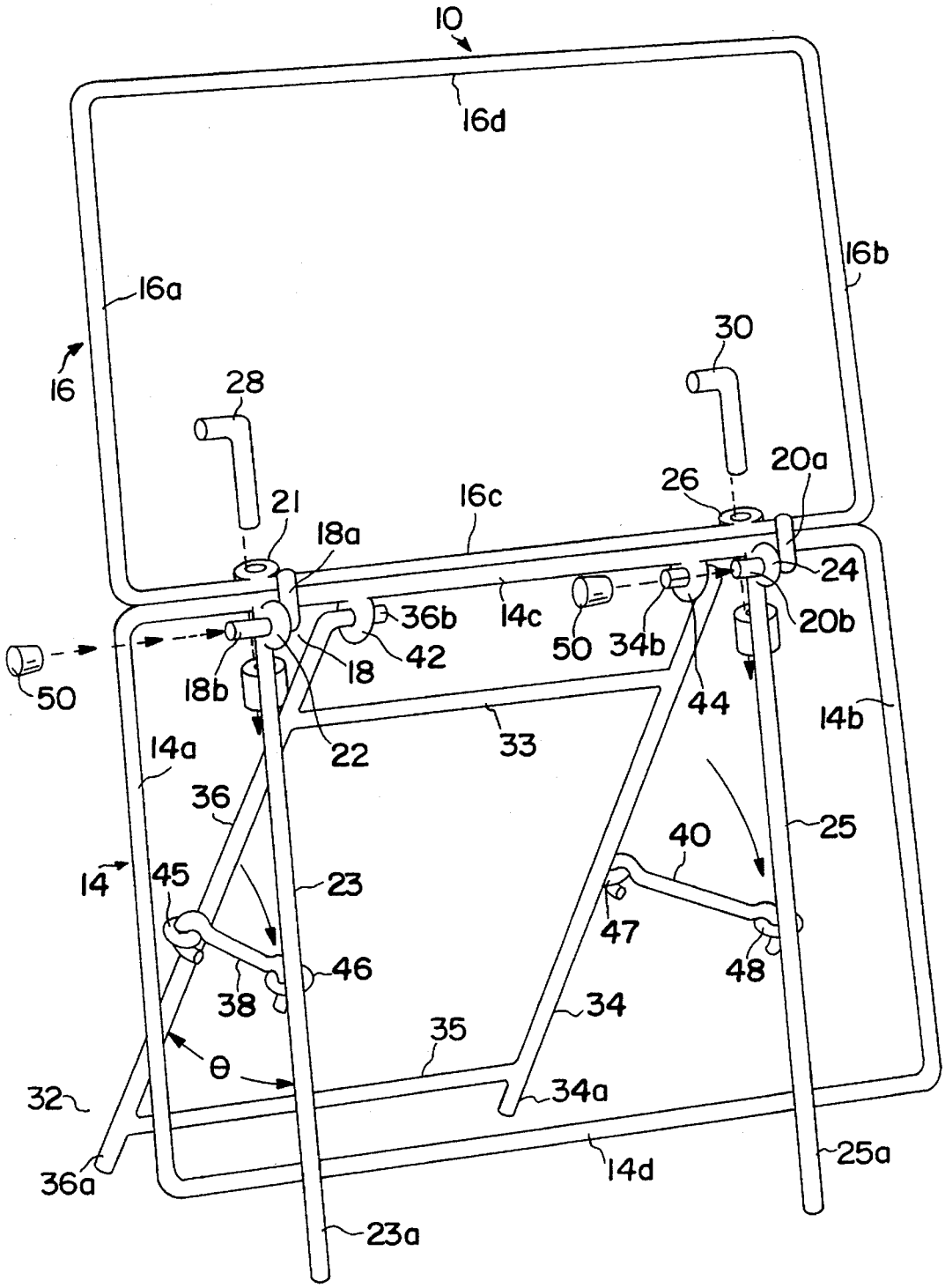
Figure 1:
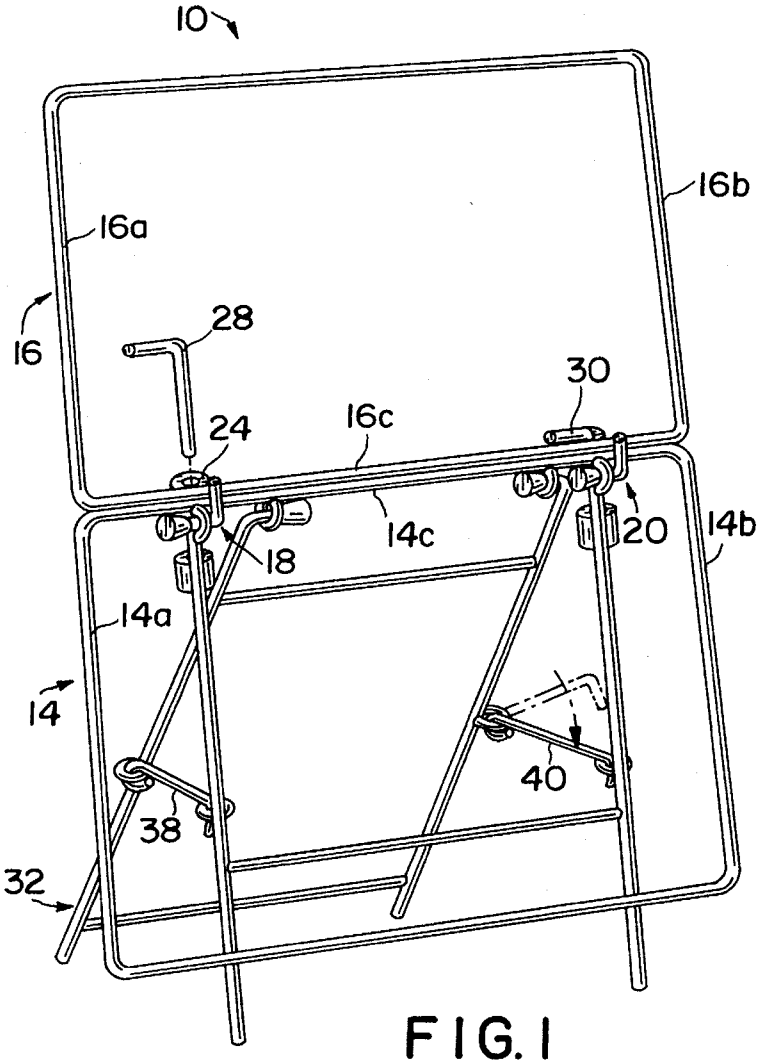

With reference to FIG. 1, there is shown an erectable wire frame display structure 10 constructed in accordance with the present invention and arranged in an unfolded or open position to define a substantially vertical supporting area suitable for receiving a wire sculpture (not shown). The erectable wire frame display structure 10 includes a lower frame assembly 14 and an upper frame assembly 16. Each frame assembly comprises first and second pairs of parallel rods or wire sections, 16*a*, 16*b* and 14*a*, 14*b*, respectively, and 16*c*, 16*d* and 14*c*, 14*d*, respectively. As shown, the wire section pairs of each frame assembly 14, 16 are interconnected or integrally formed to define a generally rectangular or square frame. As will become more apparent from the description of the embodiment of the present invention depicted in FIG. 4, many variations in the number and arrangement of rod sections can be made and it should be emphasized that the particular configurations described and illustrated herein are for illustrative purposes only.

In any event, and as more clearly shown in FIG. 1*a*, it will be observed that the lower transverse rod section 16*c* of upper frame assembly 16 and the upper transverse rod section 14*c* of the lower frame assembly 14 are pivotally connected by hinges 18 and 20. Although any suitable hinge structure may be utilized for this purpose, in the present embodiment hinges 18 and 20 are constructed as L-shaped members having a vertical portion 18*a*, 20*a* secured, as by welds, to the lower transverse rod section 16*c* and a horizontal portion 18*b*, 20*b* extending therefrom.

With continued reference to FIG. 1*a*, it will be observed that vertically extending parallel wire sections 23 and 25 interconnect the upper and lower transverse sections of frame assembly 14. For a purpose which will be explained later, the lower ends 23*a* and 25*a* of vertical members 23 and 25, respectively, extend below the bottom of the lower transverse section 14*d* of frame assembly 14. Secured or otherwise formed on each of wire sections 23 and 25 are respective eyehooks 22 and 44. The eyehooks, which are positioned near the upper end of each wire section, define respective apertures aligned and dimensioned to receive the horizontal portions 18*b* and 20*b*, respectively, of hinges 18 and 20. As shown in FIGS. 1 and 1*a*, once the horizontal portions have been inserted into the apertures, the ends thereof are covered by end caps 50, which are preferably made of an elastomeric material such as rubber. Essentially, end caps 50 serve not only to prevent the portions 18*a* and 20*b* from sliding out of the apertures, but also to cover any sharp edges which might otherwise injure the user.

Because the upper and lower frame assemblies are interconnected by the hinges in the manner set forth above, the upper frame assembly 16 can be rotated upwardly from a folded, first position (FIG. 2) to the unfolded, second position depicted in FIGS. 1 and 1*a*. Specifically, the upper frame assembly is rotated from the folded position until the vertical portions 18*a* and 20*a* of each hinge abut the upper transverse section 14*c* of lower frame assembly 14.

Figure 2:
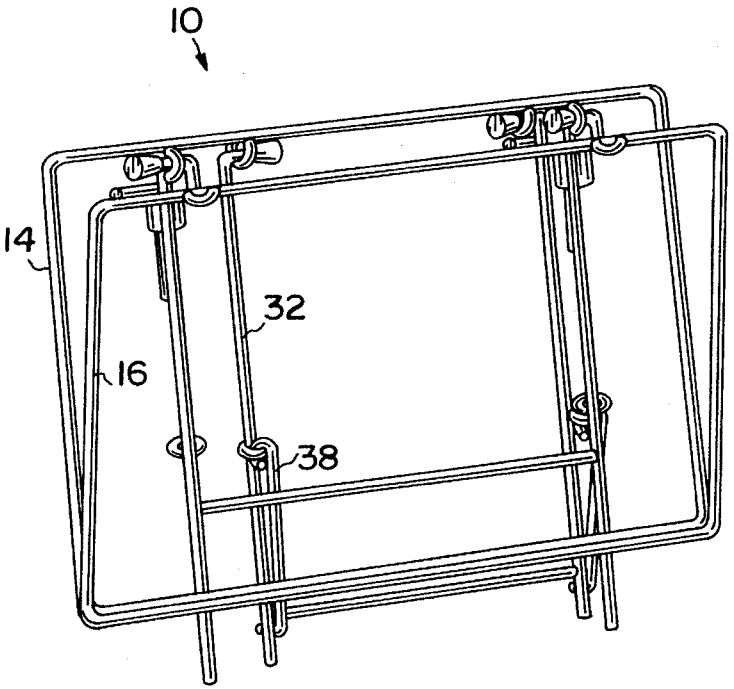
FIG. 2, is a perspective view of the erectable wire frame of FIG. 1 folded into a closed position for easy handling and storage.

As indicated above, FIG. 2 depicts the display structure of the present invention in the folded position. In the folded position, the upper and lower frame assemblies 16 and 14 are oriented in substantially parallel planes such that the front surfaces thereof are in a face-to-face face relation. In the unfolded position depicted in FIGS. 1 and 1*a*, the upper frame assembly 16 is oriented above and in substantially the same plane as the lower frame assembly 14.

With continued reference to FIG. 1*a*, it will be seen that the display structure of the present invention further comprises means for interlocking the upper and lower frame assemblies together so as to retain the front surfaces thereof in a coplanar relationship. For this purpose, secured to or otherwise formed on the rear surface of lower transverse rod section 16*c* are a pair of retaining means, such as eyehooks, 21 and 26, which define a pair of vertically oriented apertures for receiving corresponding retaining pins 28 and 30.

As will be readily appreciated by those skilled in the art, when pins 28 and 30 are inserted into retaining means 21, 26, they lock the lower and upper frame assemblies in the unfolded, operative position. Thus, unlike prior art wire frame structures in which a retaining force is exerted in a direction parallel to the rotation axis of a joining hinge, the retaining pins 28, 30 of the present invention exert a retaining force in a direction perpendicular to the axis of horizontal hinge portions 18*b* and 20*b*. As such, forward pivoting movement of the upper frame assembly 16 around the hinge rotation axis is reliably prevented.

As indicated above, it is an object of the present invention to provide a display supporting structure which may be secured to a vertical mounting surface or supported on the ground or other planar surface in a freestanding manner. In order to achieve the latter object, the present invention utilizes ground engaging leg sections which may either be inserted into the ground, or directly supported on a substantially horizontal planar support surface. The first pair of ground engaging leg sections are defined by lower sections 23*a* and 25*a* of lower frame assembly 14. As indicated above, these sections are part of parallel, vertically extending sections 23 and 25, and they both extend below lower transverse section 14*d* by the same, predetermined length. It should, of course, be understood that additional parallel leg sections depending from lower transverse section 14*d* may be provided for additional stability.

In order to provide a suitably stable arrangement having at least four points of support, the display support structure of the present invention further includes a rear frame assembly 32. As shown in FIG. 1*a*, rear frame assembly 32 comprises a pair of parallel, vertically extending rod sections 34 and 36 which are interconnected by upper and lower transverse rod sections 33 and 35. In accordance with the display support structure of the present invention, lower sections 34*a* and 36*a* of frame sections 34 and 36 both extend below lower transverse section 35 by the same predetermined distance to form third and fourth ground engaging leg sections.

To provide a compact, easy to store display support structure, rear assembly 32 is pivotally connected to lower frame assembly 14 and is rotatable between a folded position and an unfolded, support position. For this purpose, the upper end regions of vertical frame sections 34 and 36 are bent to form respective elbow sections 34*b* and 36*b* and first and second eyehooks 42 and 44 are secured to or otherwise formed on the lower surface portion of upper transverse section 16*c*. As seen in FIG. 1*a*, eyehooks 42 and 44 define a pair of aligned apertures which receive elbow sections 36*b* and 34*b*, respectively. For the purposes discussed above, additional end caps 50 are positioned on the ends of the elbow sections 34*b* and 36*b* in the manner shown in FIG. 1.

In order to lock rear assembly 32 at an optimal unfolded angle θ relative to the lower frame assembly 14, the rear assembly further includes first and second retaining members 38 and 40 which are adapted to interconnect sections 36 and 23 and sections 34 and 25, respectively. For this purpose, eyehooks 45 and 46 are formed on or otherwise secured to sections 36 and 23, respectively, and eyehooks 47 and 48 are similarly provided on sections 34 and 25, respectively. As shown in FIGS. 1 and 1*a*, each eyehook is arranged to define an aperture dimensioned to receive one end of a retaining member when the rear assembly is positioned at the proper, predetermined angle relative to the lower frame assembly.

As will be readily appreciated by those skilled in the art, the retaining members 38, 40 are therefore configured such that one end of each is hingeably connectable to vertical supports 34, 36 such that the other end can be pivoted forward to hook into eyehooks 48 and 46, respectively. When so interconnected, the rear frame assembly 32 extends rearwardly from the lower frame assembly 14 at a predetermined angle so that the entire wire frame display structure 10 is firmly supported on four points of support provided by leg sections 23*a*, 25*a*, 34*a*, and 36*a*. The selected angle between the lower frame assembly and the rear assembly can, of course, be modified substantially without substantially affecting the stability of the structure. Thus, the angle formed when the rear frame assembly 32 is fully extended can range from about 10° to about 80°, but is preferably about 30°.

The display support structure of the present invention is flexible in that it can be used in a variety of situations. On a hard, substantially planar surface, for example, the leg sections define four fixed points of support. To facilitate use indoors, additional end caps (not shown) may be placed on the bottom of each leg section to prevent sharp surfaces thereof from scratching floors or other surfaces. Outdoors, the structure can be made to conform to an uneven ground or lawn surface by partially inserting one or more leg sections into the ground. Moreover, all tour leg sections may be anchored into the lawn or ground surface to provide maximum stability against adverse weather conditions.

Figure 3:
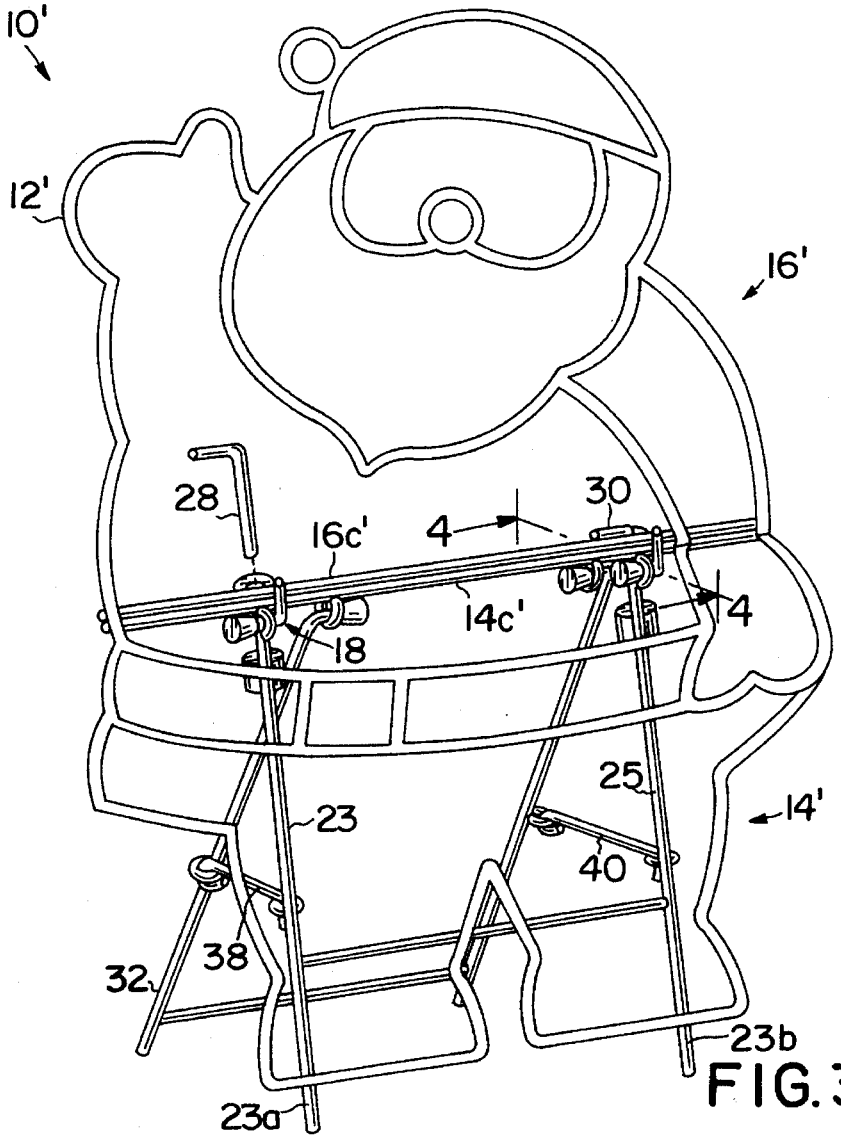
FIG. 3 is a perspective view depicting an alternate embodiment of the invention wherein the wire/light sculpture itself forms the wire frame.

An alternate embodiment of the present invention is depicted in FIG. 3, wherein like reference numerals refer to like elements, it will be recalled that the embodiment of FIG. 1 is configured to permit a wire sculpture to be fastened or attached thereto. In accordance with the embodiment depicted in FIGS. 3 and 4, however, a support structure constructed in accordance with the present invention is actually integrated into a wire frame sculpture. More accurately, the wire sculpture 12 forms a portion of the display structure 10.

As seen in FIG. 3, the upper frame assembly 16 includes a lower transverse section 16*c* and the lower frame assembly 14 includes an upper transverse section 14*c*, the sections 14*c* and 16*c* being hingedly joined in the same manner described above in connection with the embodiment of FIGS. 1 and 1*a*. The lower frame assembly 14 further includes parallel frame sections 23 and 25, which, as before, are connected to transverse section 14*c* and depend downwardly therefrom to define leg sections 23*a* and 25*a*. As shown in FIG. 3, however, each of the upper and lower frame assemblies has been configured as a pattern of interconnected wire sections that, when aligned in the unfolded position shown in FIG. 4, constitute a wire sculpture. As will be readily appreciated by those skilled in the art, the sculpture may depict a figure, character, scene, or symbol, or any other desired form to be displayed. Additionally, and in accordance with the preferred commercial embodiment as presently contemplated, lights or light tubes of different colors may be secured to the wire pattern to define a light sculpture, thereby permitting a wide variety of illuminated figures and characters to be displayed.

Figure 4:
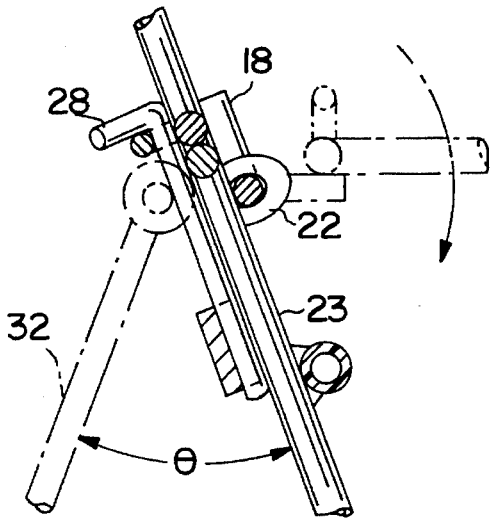
FIG. 4 is a cross-sectional view taken along lines 4—4 in FIG. 3, depicting the placement of the retaining pin required to lock the wire frame in its upright or open position.

It will be observed that in all other respects, the assembly 10 is identical to the embodiment depicted in FIG. 1. Thus, in an identical manner, rear frame assembly 32 is hingedly connected to transverse section 14*c* of lower frame assembly 14. Additionally, retaining members 38 and 40 are again utilized to retain the two frame assemblies at a predetermined angle θ (FIG. 4).

In accordance with either embodiment of tile present invention, the structure is folded for storage by removing retaining pins 28 and 30 and rotating upper frame assembly 16 approximately 180° into a face-to-face relationship with lower frame assembly 14, (FIG. 2). The retaining members 38 and 40 are unhooked to allow the rear frame assembly 32 to be folded flush against the lower frame assembly 14. The folded configuration is sufficiently compact for easy handling and storage.

It should be understood that the preferred embodiments and examples described are for illustrative purposes only and are not to be construed as limiting the scope of the present invention which is properly delineated only in the appended claims.

What is claimed is:

1. An erectable wire frame display structure comprising:

an upper frame assembly including at least one wire section connected to a transverse wire section, wire sections of the upper frame assembly defining a first portion of a wire sculpture;

a lower frame assembly including at least one wire section connected to a transverse wire section and a pair of leg sections, downwardly depending from the transverse wire section of the lower frame assembly, wire sections of the lower frame assembly defining a second portion of said wire sculpture:

hinge means for pivotally interconnecting said upper and lower frame assemblies, said hinge means comprising a first plurality of apertures defined by one of said upper and lower frame assemblies and respective hinge members each having a first portion insertable into said apertures and a second portion secured to the other of said frame assemblies, and said upper frame assembly being pivotable about an axis from a first position, in which surfaces of said first and second sculpture portions are substantially parallel to a second position, in which surfaces of said first and second sculpture portions are substantially coplanar;

retaining means for selectively retaining said upper frame assembly in said second position, said retaining means comprising a second plurality of apertures defined by one of said frame assemblies and a respective plurality of pin members insertable into said second plurality of apertures; and a rear support assembly hingeably connected to said lower frame assembly, said rear support assembly including a pair of parallel leg sections and means for fixedly positioning the leg sections of the rear support assembly at a predetermined angle relative to the leg sections of said lower frame assembly.

2. The erectable wire frame display structure of claim 1, wherein the second portion of each hinge member is a vertical portion connected to the transverse section of said upper frame assembly and the first portion of each hinge member is a horizontal portion, each hinge member being dimensioned and arranged to allow the upper frame assembly to be rotated upwardly from said first position until the vertical portions abut the transverse section of the lower frame assembly.

3. The erectable wire frame display structure of claim 2, wherein the first plurality of apertures are defined in the downwardly depending leg sections of the lower frame assembly.

4. The erectable wire frame display structure of claim 1, wherein the transverse section of the lower frame assembly defines a third plurality of apertures and wherein each leg section of the rear support assembly includes an L-shaped upper portion insertable into said third plurality of apertures, said L-shaped portions acting as pivoting pins to permit rearward extension of the rear support assembly.

5. The erectable wire frame display structure of claim 1, wherein the parallel leg sections of the rear support assembly and the downwardly depending leg sections of the lower frame assembly define respective sets of aligned apertures and wherein said means for fixedly positioning includes first and second latching members insertable into corresponding sets of said aligned apertures.

6. The erectable wire frame display structure of claim 5, wherein said latching members are dimensioned and arranged so that the predetermined angle is between 10° to 80°.

7. The erectable wire frame display structure of claim 1, wherein the predetermined angle is between 10° to 80°.

8. The erectable wire frame display structure of claim 1, wherein the predetermined angle is 30°.

9. The erectable wire frame display structure of claim 4, wherein said first and second pluralities of apertures are defined by eyehooks secure to respective frame assemblies.

10. The erectable wire frame display structure of claim 1, wherein wire sections of said upper and lower frame assemblies are dimensioned and arranged to define a wire sculpture when said upper frame assembly is in said second position.

11. An erectable wire frame display structure comprising:

an upper frame assembly including at least one wire section connected to a transverse wire section, wire sections of the upper frame assembly defining a first portion of a wire sculpture;

a lower frame assembly including at least one wire section connected to a transverse wire section and a pair of leg sections, downwardly depending from the transverse wire section of the lower frame assembly, wire sections of the lower frame assembly defining a second portion of said wire sculpture;

hinge means for pivotally interconnecting said upper and lower frame assemblies, said hinge means comprising a first plurality of apertures defined by one of said upper and lower frame assemblies and respective hinge members each having a first portion insertable into said apertures and a second portion secured to the other of said frame assemblies, and said upper frame assembly being pivotable about an axis from a first position in which surfaces of said first and second sculpture portions are substantially parallel, to a second position, in which surfaces of said first and second sculpture portions are substantially coplanar;

retaining means for selectively retaining said upper frame assembly in said second position, said retaining means comprising a second plurality of apertures defined by one of said frame assemblies and a respective plurality of pin members insertable into said second plurality of apertures;

a rear support assembly hingeably connected to said lower frame assembly said rear support assembly including a pair of parallel leg sections and means for fixedly positioning the leg sections of the rear support assembly at a predetermined angle relative to the leg sections of said lower frame assembly; and means for illuminating at least one portion of one of said first sculpture portion and said second sculpture portion.

12. The erectable wire frame display structure of claim 11, wherein said illuminating means includes a plurality of light emitting elements secured to wire sections of each of said first and second sculpture portions.

13. The erectable wire frame display structure of claim 1, wherein said hinge means pivots said upper and lower frame assemblies about an axis offset from said transverse wire sections of said upper and lower frame assemblies.

* * * * *